US005167770A

United States Patent [19]

Bubik et al.

[11] Patent Number: 5,167,770

[45] Date of Patent: Dec. 1, 1992

[54] DE-WATERING APPARATUS IN A TWO-WIRE FORMER

[75] Inventors: Alfred Bubik; Hans Dahl, both of Ravensburg; Otto Hildebrand, Ravensburg-Taldorf; Karl Müller, Ringgenweiler; Jörg Walter, Ravensburg, all of Fed. Rep. of Germany

[73] Assignee: Sulzer-Escher Wyss GmbH, Ravensburg, Fed. Rep. of Germany

[21] Appl. No.: 873,630

[22] Filed: Apr. 22, 1992

Related U.S. Application Data

[63] Continuation of Ser. No. 645,144, Jan. 24, 1991, abandoned.

[30] Foreign Application Priority Data

Jan. 26, 1990 [DE] Fed. Rep. of Germany ..... 4002305
Aug. 25, 1990 [DE] Fed. Rep. of Germany ..... 4026953

[51] Int. Cl.[5] ..... D21F 1/00

[52] U.S. Cl. ..... 162/301; 162/203; 162/352

[58] Field of Search ..... 162/300, 301, 348, 352, 162/203

[56] References Cited

U.S. PATENT DOCUMENTS 4,414,061 11/1983 Trufitt et al. ..... 162/301
4,609,435 9/1986 Tissari ..... 162/352
4,769,111 9/1988 Nevalainen et al. ..... 162/301
4,917,766 4/1990 Koivuranta et al. ..... 162/301
4,925,531 5/1990 Koski ..... 162/301

FOREIGN PATENT DOCUMENTS 3138133 3/1983 Fed. Rep. of Germany ..... 162/301
3153305 10/1986 Fed. Rep. of Germany ..... 162/301
89/02499 3/1989 PCT Int'l Appl. ..... 162/301

OTHER PUBLICATIONS

Baumann "New Top Wire Forming Unit", Pulp and Paper, Apr. 1989.

*Primary Examiner*—Karen M. Hastings
*Attorney, Agent, or Firm*—Wolf, Greenfield & Sacks

[57] ABSTRACT

The de-watering apparatus for a two-wire paper machine is constructed in such a manner that following the convergence of both wires, firstly, a uniform pressure at a forming roll is exerted on the suspension layer located between the wires. Subsequently, both wires pass de-watering rails which may be located in the upper and/or the lower wire. In this case, an under-pressure is exerted at least at the rails located in the upper wire. At least one further de-watering member then follows before both wires are separated again. The de-watering apparatus can also be used after a preliminary de-watering section, for example an endless wire, and also in the direct vicinity of a head box.

23 Claims, 6 Drawing Sheets

DE-WATERING APPARATUS IN A TWO-WIRE FORMER

This application is a continuation of application Ser. No. 07/645,144, filed Jan. 24, 1991, now abandoned.

The invention relates to the de-watering apparatus in a two-wire former as well as its advantageous application.

Two-wire formers of this kind can be operated in the direct vicinity of a headbox, the suspension being sprayed as a flat jet in the space formed between the convergence of the wires and subsequently being de-watered between the wires, but they can also be provided with a preliminary de-watering (pre-de-watering) section in which it is provided for that the suspension emitting from the headbox is guided onto a wire along a particular section in which a portion of the contained water can already be removed out of the suspension, in particular downwardly, before entry into the two-wire former. The preliminary de-watering section is then followed by the apparatus of the type described here, wherein as a rule, the preliminarily de-watered suspension remains on the wire, and by leading a further wire to this, the two-wire former is formed.

A de-watering apparatus in a two-wire former, which comprises at the start an open, rotatable forming roll located in the upper wire, subsequently a non-following de-watering section and a further open, rotatable forming roll following this, is known, for example, from the European patent EP-0 101 709. In this apparatus, all measures have been taken in such a manner that the dewatering takes place predominantly upwardly in the region of the two-wire. In other embodiments, as, for example, described by the U.S. Pat. No. 4,414,061, only a portion of the water is removed through the dewatering section located in the upper wire, while a portion of the water is also removed downwardly ahead of and behind these dewatering members through the watering members arranged in the lower wire, which generate an under-pressure, wherein the latter de-watering members can selectively be rotated or stationary. Another different embodiment is known from the German patent 31 38 133 of the applicant. Here it is proposed to arrange deflection members in the upper or lower wire region for the entire de-watering taking place in the two-wire region such that the wires led between these can be formed into a convenient shape.

Despite the number of known apparatus of the type relating to the subject matter of the invention, one has not succeeded up to now in solving all problems, these problems arising because various requirements must be fulfilled in the sphere of these apparatus which at least partially contradict eachother: Firstly, a fiber web which solidifies as homogeneously as possible should be formed (the formation should be optimal), secondly, the fine material present in the fiber web in addition to the fiber should remain in the fiber web in as large a proportion as possible (as high a retention as possible), even though it can be washed out with the water on account of its size and constitution, thirdly, the concentration progression of the fine material as seen through the thickness of the web should have a desired form, and, in the fourth place, a considerable portion of the water contained in the suspension should be removed.

It is an object of the invention to achieve the previously mentioned aims such that they are balanced with respect to one another in an as favourable a manner as possible, and, with this, to maintain the input pertaining to the apparatus structurally and operatively as low as possible.

The inventive apparatus is particularly suited to ensure a desired and partially intensive pressure treatment for improving the formation and, in general, a higher de-watering performance. This is made possible for example by an initial non-pulsating, uniform de-watering in a short section, for example 200 mm, and then by a subsequent de-watering with a frequent reversal in direction. In the region of the non-following de-watering section positioned in the upper screen, the spacing of the consecutive rails is advantageously maintained relatively small, for example between 10 to 60 mm in order to effect a frequent change in direction of the de-watering flow.

Because the de-watering section located in the upper wire can be subjected to an under-pressure, the mechanical pressure exerted by the rails on the wires can remain relatively small for the same de-watering performance, whereby the formation can be advantageously influenced. The pressure exerted by the rails on the wires leads to an orientation of the fibers in the direction of movement of the machine. Thus, the braking length relationship longitudinal/transverse is increased, which can be undesirable dependent upon the type of paper.

Should equally intensive pulses be generated on both sides and should they act approximately simultaneously, the filling is removed from the edge layers of the suspension to a relatively considerable extent. Thus, a desirable progression as seen over the thickness of the sheet can be set in an advantageous manner, for example, in that the filling content in the center of the sheet is greater than that at the upper or lower side. A sheet created in this way is, for example, well suited for printing in offset printing processes. Paper or cardboard of this kind have a particularly large surface strength. With a particular adjustment of the pulsation, the manufacture of a symmetrical sheet is also possible.

Further advantages result if the de-watering member located in the upper wire is divided into different zones with different pressures.

At the start, a so-called auto-slice which draws off the water in and over the upper wire can be advantageous, and particularly then when it is mounted close to the formation roll, as it achieves an effective de-watering even at a relatively low wire velocity.

In the case that rails located in the lower wire are, for example, spring-mounted or as a particular advantage adjustable, the achieving of an optimal formation is effectively promoted. In cooperation with the rails of the de-watering section present in the upper wire, a frequent change in the direction of de-watering results for the fiber suspension.

On the other hand, should the lower de-watering section be formed without the stationary parts contacting the lower wire, then a contact controllable by friction results at the arc-shaped forming shoe in the upper wire when both wires led together pass by, on the basis of which contact one can react flexibly to surface weight changes of the matrixed suspension layer. The rejustment of rails lying opposite is then no longer applicable.

A further advantage of the inventive subject matter is the relatively short length of the de-watering sections as seen in the direction of movement of the wire. On account of the very intensive area effective in de-dewatering which joins up with the first formation roll, wrapping around at the first formation roll can be kept small, which in turn promotes good formation.

A steady water flow at the wires constant across the width of the sheet is also present at the rails of the de-watering section in the upper wire on account of the shortness of this area, whereby a soiling on account of deposites from the wire water is virtually ruled out. Thus, paper desirably free of stripes can be achieved. The sheet formation is concluded by means of at least one subsequently arranged additional de-watering member.

Basically, the inventive subject matter facilitates a number of regulating possibilities, for example through good accessibility and, if provided, a good adjustment of the lower rails, which makes the flexible adaptation of the de-watering apparatus to several concievable operative conditions possible.

BRIEF DESCRIPTION OF THE DRAWINGS

The inventive apparatus as well as particularly advantageous embodiments are explained as follows by means of the drawings in which:

In FIG. 1, an upper wire 1 having a deflection roll 3 and a lower wire 2 can be seen which converge in the operative area of an especially open form roll 4 and thus form a two-wire zone. As seen in the direction of movement, located behind the point of convergence of the wires is a de-watering section 5 having rails 7 in the upper wire, and a de-watering section 6 with rails 10 in the lower wire. The de-watering section 5 has at the start an auto-slice 13 which is followed by two further suction zones acted upon by an under-pressure, the water withdrawn being collected in the water box 8 and removed via the conduit 9. The position of the de-watering section 5, relative to the wires, is variable by means of the adjusting apparatus 14, which can include a spring mechanism, and which functions to press each of the upper rails against the upper sieve. The de-watering section 6 in the lower wire 2 is equipped with de-watering rails 10 in this case, which rails can be submerged into the two-wire 1, 2 in the operative area of the de-watering section 5. Additionally, a further rail is shown which pushes against the wire 2 already in the operative area of the first de-watering section 5. The water emitting from the lower de-watering section is collected by a water box 12 and removed.

Figure 1:
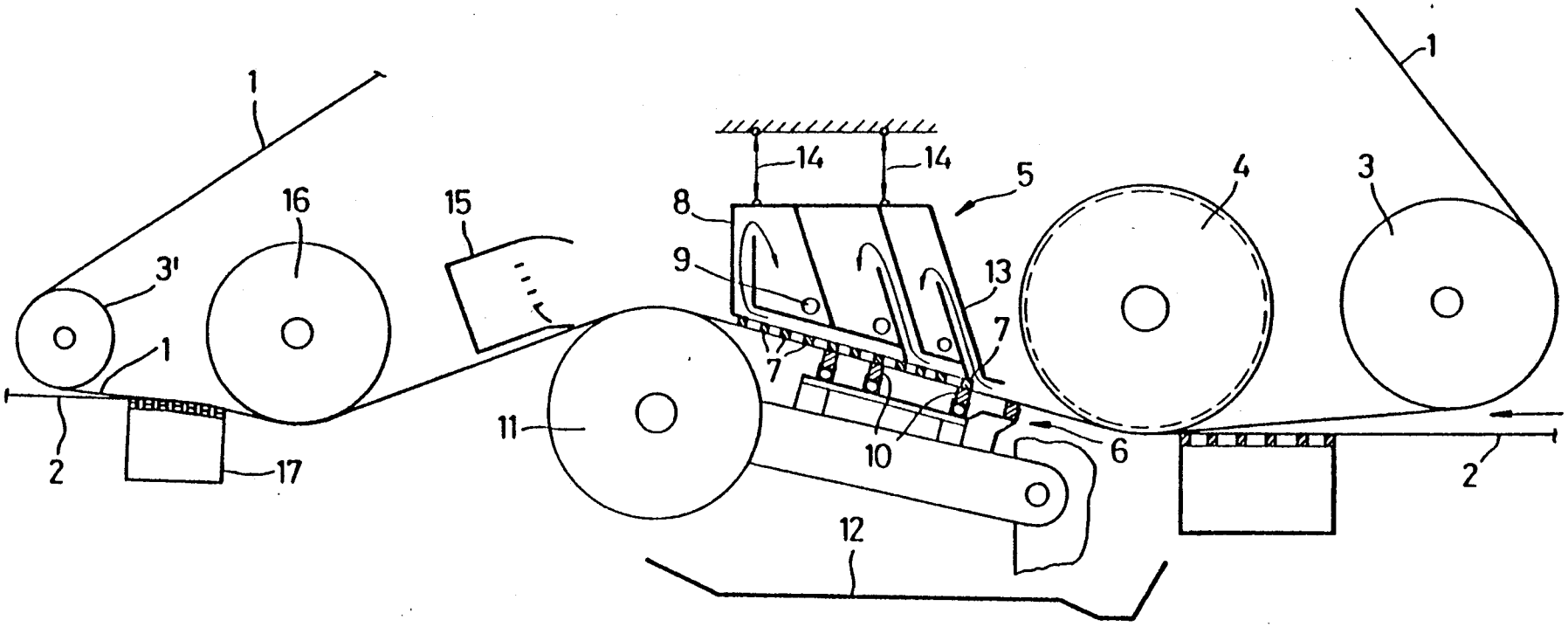
FIG. 1 is a schematic depiction of the inventive de-watering apparatus installed after an endless wire preliminary de-watering process.

As seen in the direction of movement of the wires, a further de-watering member 11 follows behind both de-watering sections 5 and 6, wherein the de-watering member 11 is a rotating roll located in the lower wire 2 provided with grooves open towards the wire and arranged in the peripheral direction, the water stemming from the suspension from rotating roll being thrown into the water box 15 and which led away. It is also conceivable to use a suction roll here. Behind a further deflection roll 16 and a following suction box 17, the wires are separated, the upper wire 1 being led back to the roll 3 and the lower wire 2 with the stock material being led to the further treatment processes of the stock.

Figure 2:
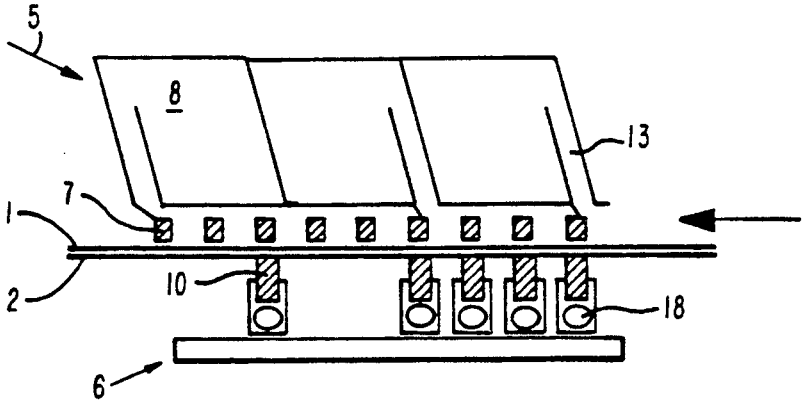
FIG. 2–4 show schematic depictions of the cooperation of the rails of the lower de-watering section with the rails of the upper de-watering section.
Figure 3:
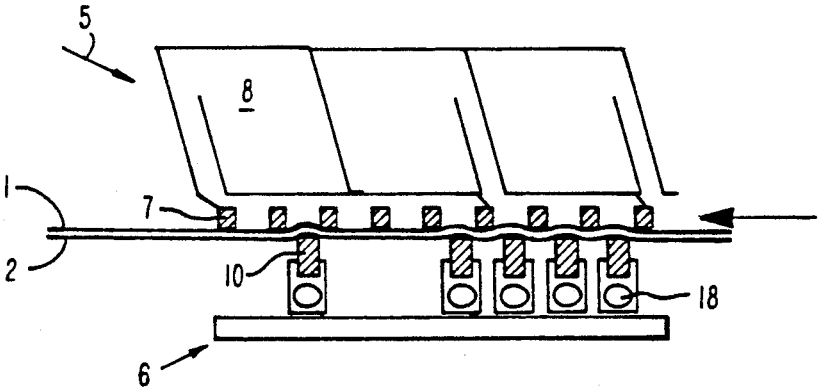

FIG. 2 shows an embodiment in which the rails 10 of the de-watering section 6 in the lower wire 2 push against the rail 7 of the de-watering section 5 located in the upper wire, while FIG. 3 shows the variation in which the lower rails 10 push into the space between the upper rails 7 and in which a wave-like form of the two-wire 1, 2 can be set. In this case, the respective rails 7 can be individually adjusted with respect to the lower wire, for example by hydraulic pressure members 18.

Figure 4:
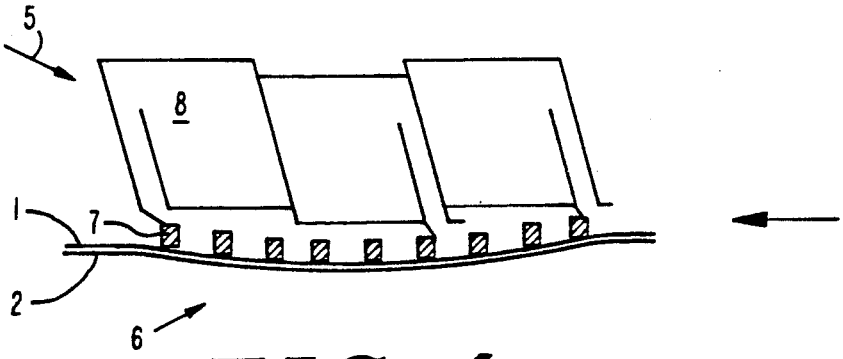

FIG. 4 shows a form of the rail arrangement of the de-watering section 5 located in the upper wire 1 which is modified in such a manner that the two-wire is led in an arcuate manner about this section. The rails possibly present in the de-watering section located in the lower wire are not shown here.

Figure 9:
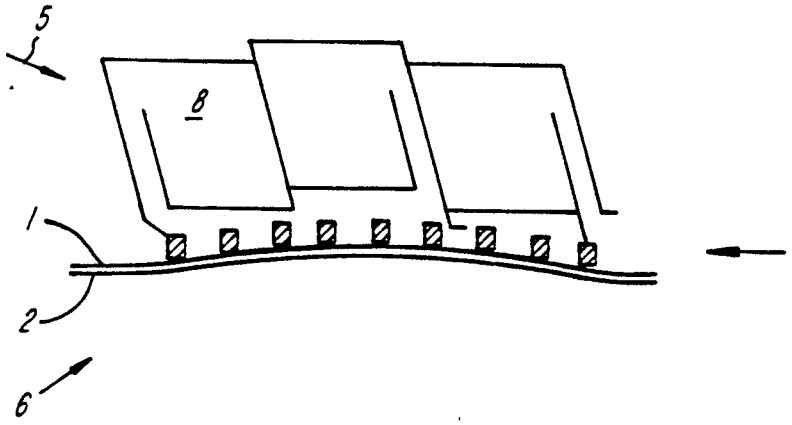
FIG. 9 shows a schematic depiction of a concave rail configuration for a de-watering section as seen from the upper wire.

FIG. 9 shows a form of the rail arrangement of the de-watering section 5 located in the upper wire 1 which is modified in such a manner that the two-wire sandwich is also led in an arcuate manner about this section . The rail possible arrangement of to the de-watering section for the lower wire is also not shown here. Note that, unlike FIG. 4, which shows a convex rail arrangement as seen through the upper wire 1, FIG. 9 depicts a concave rail arrangement as seen through the upper wire. The water box 8 is, likewise, shaped to conform to this concave arrangement.

Figure 5:
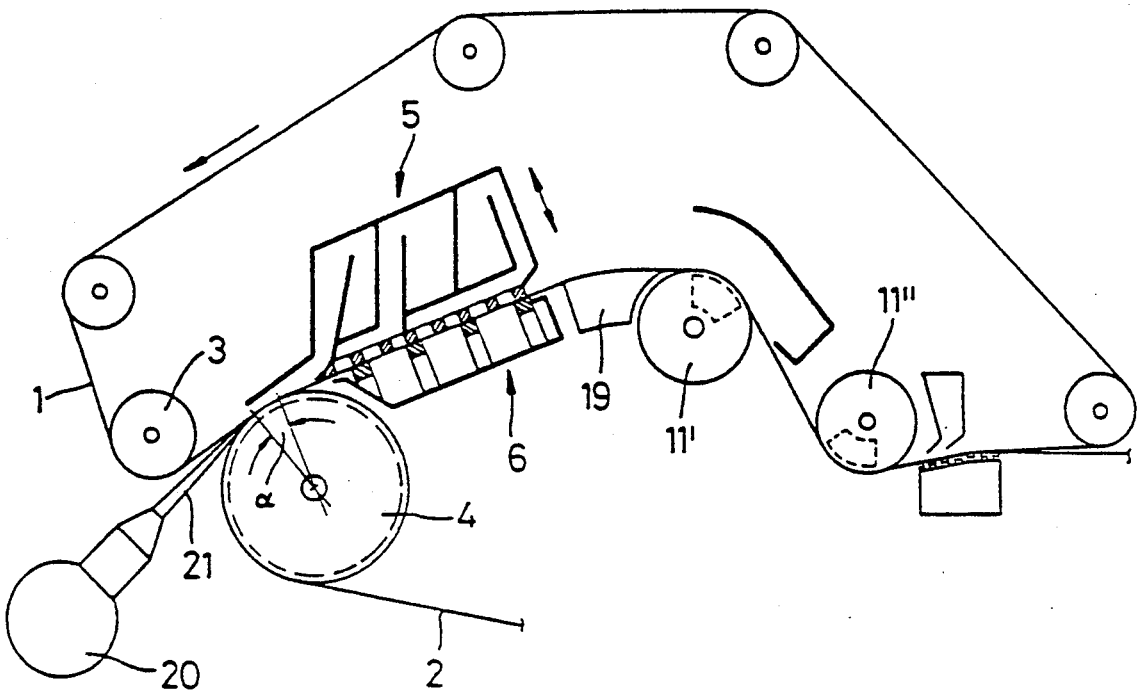
FIG. 5 schematically shows the inventive subject matter in a so-called GAP-former.

FIG. 5 shows the inventive subject matter used in a paper machine without a preliminary de-watering section. A head box 20 forms a flat jet 21 which is fed directly into the space between the two converging wires. A two-wire former formed in this way is also called a GAP-former in the technical field. The shown embodiment is provided with the formation roll 4 in the lower wire 2, which roll is contacted in an advantageous manner by the wires along a wrapping angle alpha of less than 25°, which corresponds to a length of below 200 mm. Suction may be applied to forming roll 4 in the region of wrapping. In this very compact arrangement particularly suited to certain paper types, the advantages of the inventive subject matter can also be applied in full. As shown, both wires are led in the direction of movement over an arcuate shoe 19 of a suction box 11' in the lower wire behind the dewatering sections 5 and 6 and then over a suction roll 11" located in the upper wire. The separation of the wires then follows.

Figure 6:
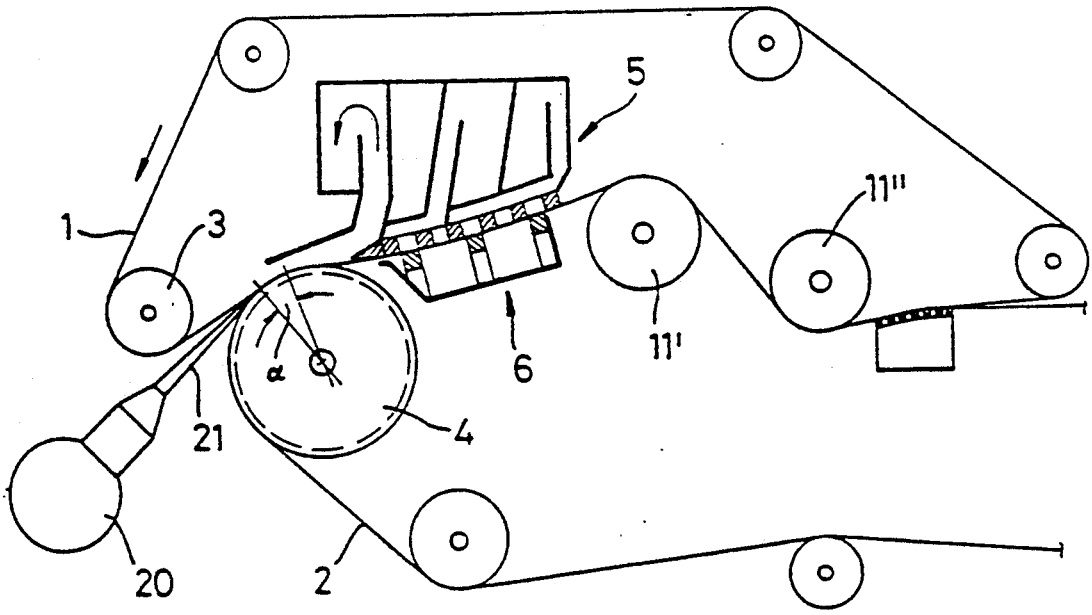
FIG. 6 shows another embodiment of a GAP-former according to the invention.

While FIG. 5 shows the embodiment with flat surfaces in the de-watering sections, FIG. 6 shows an apparatus with arched de-watering sections in which the de-watering effect is further increased by tension in the wire and be centrifugal effects. An underpressure or an overpressure can be generated between the rails in the lower wire by applying suction or pressure to the box shown around the rails at 6 in FIGS. 5 and 6.

Figure 7:
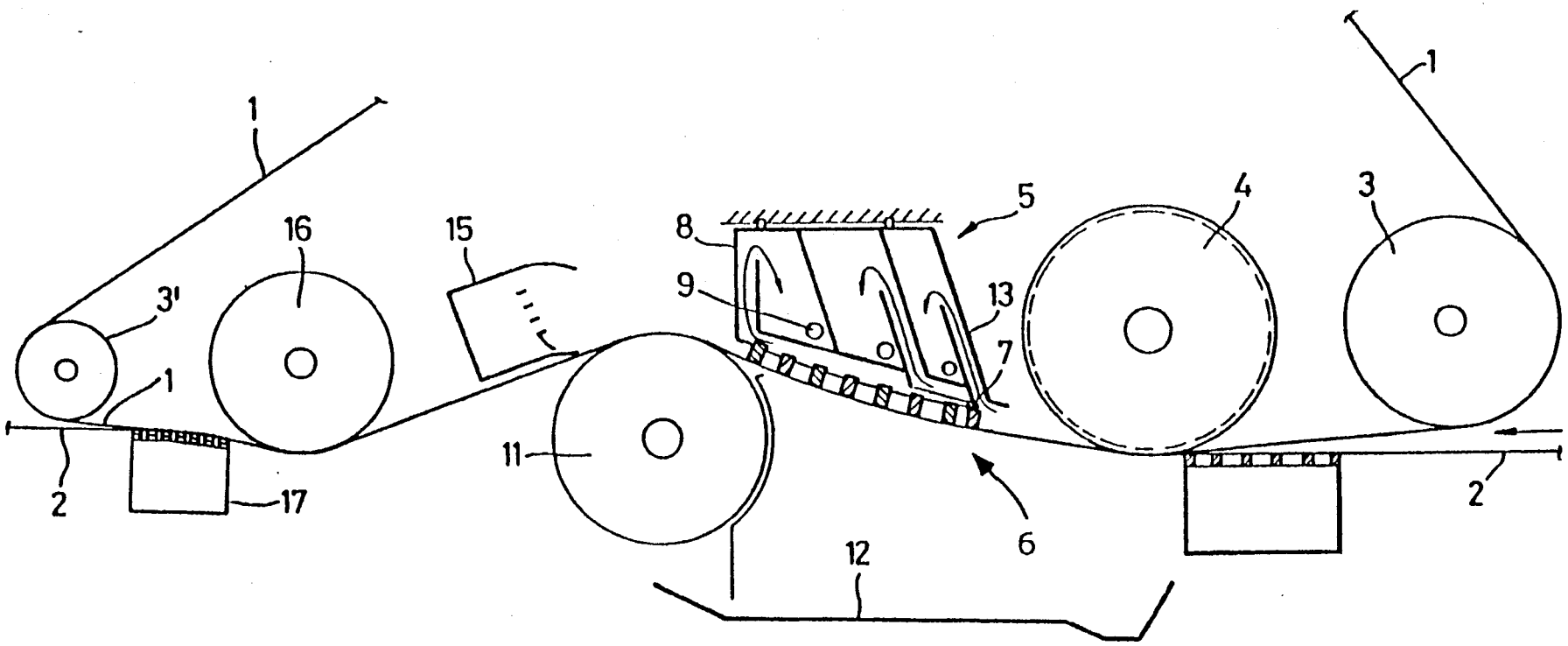
FIG. 7 shows an embodiment without stationary rails in the lower wire.

In FIG. 7, an upper wire 1 having a deflection roll 3 and a lower wire 2 can be seen which converge in the operative region of a forming roll 4 which, in particular, is open, and thus form a two-wire zone. Behind the convergence point of the wires as seen in the direction of movement, a de-watering section 5 having rails 7 is located in the upper wire in such a manner that the two-wire is led around this section in an arcuate form, thus an apparatus with arched de-watering sections, in which the de-watering effect can be further increased by tension in the wire and by centrifugal effects. The de-watering section 5 has at the start an auto-slice 13 which is followed here by two additional suction zones upon which an under-pressure acts, the withdrawn water being collected in the water box 8 and removed via the pipe 9. The position of the de-watering section 5 relative to the wires can be varied by means of an adjustment apparatus not shown. The quantity of water emitting from the lower de-watering section 6 is collected and removed by means of a water box 12.

Figure 8:
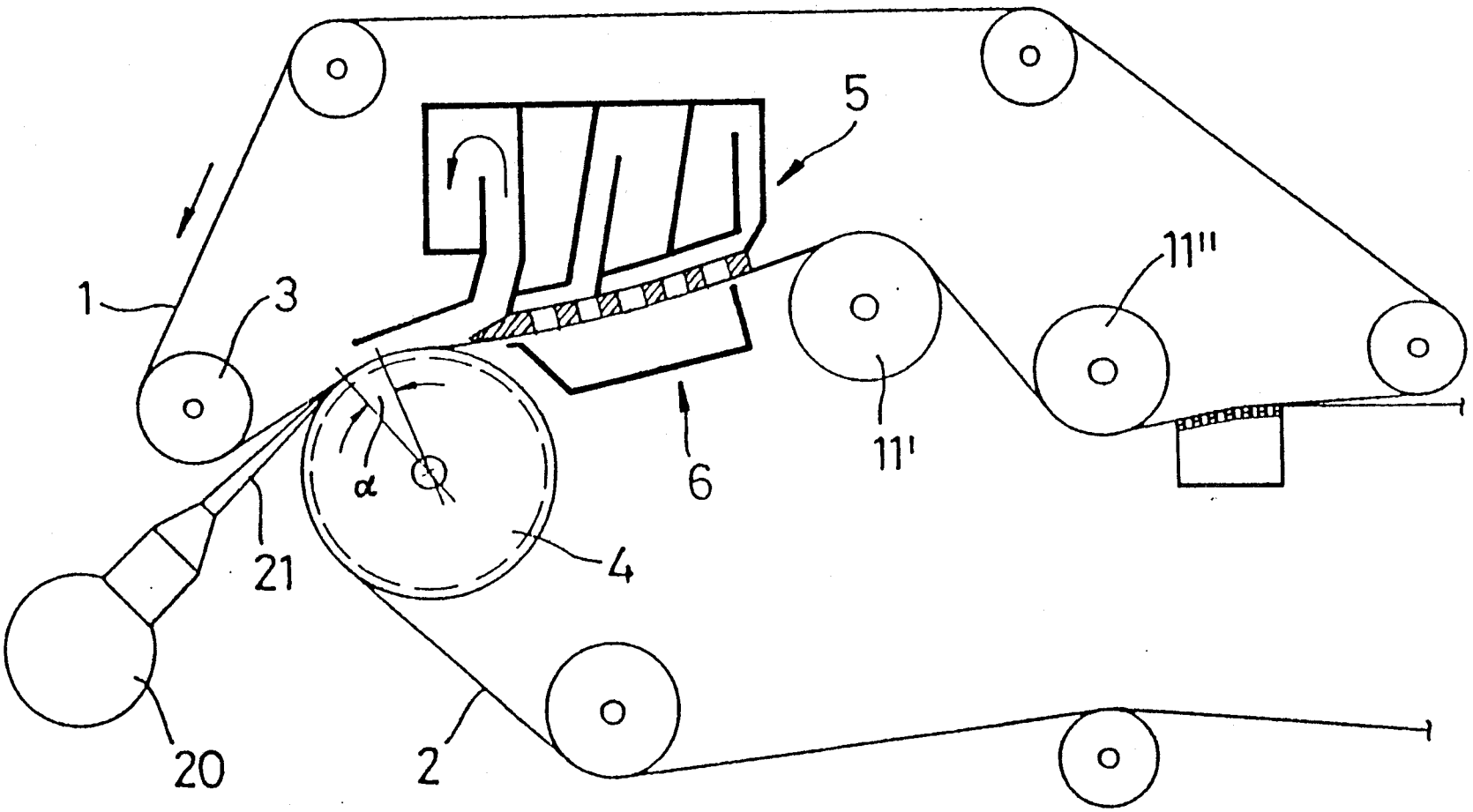
FIG. 8 shows an embodiment as a GAP-former without stationary rails in the lower wire.

FIG. 8 shows an example of the inventive subject matter in which the paper machine is used without a preliminary de-watering section. A head box 20 generates a flat jet 21 which is introduced directly into the space between the two converging wires. A two-wire former formed in this way is also called a GAP-former in the technical field. The depicted embodiment comprises the formation roll 4 in the lower wire 2, the wires coming into contact in an advantageous manner with this over a wrapping angle alpha of approximately 15°–45°, which corresponds to a length of less than 400 mm. In this very compact arrangement suitable for certain paper types, the advantages of the inventive subject matter can also be used to the full. As shown, both wires are led over an arcuate shoe 19 of a suction roll 11' located in the lower wire in the direction of movement behind the de-watering sections 5 and 6 and then over a suction 11'' located in the upper wire. The separation of the wires then follows.

What is claimed is:

1. Dewatering apparatus in a two-wire former having a lower flexible wire sieve and an upper flexible wire sieve, means for positioning said lower sieve parallel to, but spaced from, and under said upper sieve to form a sandwich with a paper suspension between said upper and said lower sieves and means for moving said sandwich in a flow direction, said sandwich passing over a first open forming roll which changes said flow direction, said dewatering apparatus comprising:

an auto-slice suction box positioned over said upper sieve at a position downstream in said flow direction from said first forming roll;

a plurality of upper rails positioned over said upper sieve and transverse to said flow direction and located at a position downstream in said flow direction from said auto-slice suction box;

means for adjusting said plurality of upper rails to press each of said upper rails against said upper sieve;

a suction box surrounding said plurality of upper rails for drawing water away from said rails, said suction box having a plurality of sections said suction box being interconnected with and extending downstream of said auto slice suction box;

means for applying a vacuum to each of said suction box sections, so that the vacuum in each section can be adjusted independently of the other sections;

lower dewatering apparatus positioned against said lower sieve opposite said suction box, said lower dewatering apparatus including a plurality of lower rials including means for independently biasing each of the rails toward the lower sieve, the lower rails being positioned so that the lower rails bear upon the lower sieve at positions thereon between each of the upper rails so that the lower rails and adjacent upper rails form therebetween a wave-like shape in the sandwich for further dewatering; and secondary dewatering apparatus positioned downstream in said flow direction from said suction box.

2. Dewatering apparatus according to claim 1, wherein each of said plurality of lower rails is separated by a predetermined lower distance from the rest of said plurality of lower rails, said lower distance being between 30 mm and 130 mm.

3. Dewatering apparatus according to claim 1, wherein said adjusting means comprises a spring mechanism so that said plurality of upper rails can move elastically in a direction transverse to said flow direction.

4. Dewatering apparatus according to claim 1, wherein each of said plurality of upper rails is separated by a predetermined upper distance from the rest of said plurality of upper rails, said upper distance being between 30 mm and 130 mm.

5. Dewatering apparatus according to claim 1, wherein said biasing means comprises means connected to each of said plurality of lower rails for moving said plurality of lower rails individually and said biasing means further comprises means connected to said plurality of lower rails for moving said plurality of lower rails in groups.

6. Dewatering apparatus according to claim 1, wherein said lower dewatering apparatus further comprises a second suction box surrounding said plurality of lower rails and means for applying a vacuum to said second suction box.

7. Dewatering apparatus according to claim 1, wherein said lower dewatering apparatus further comprises a pressure box surrounding said plurality of lower rails and means for applying pressure to said pressure box.

8. Dewatering apparatus according to one of claims 1 or 3, wherein said secondary dewatering apparatus comprises first means for removing water from said sandwich through said lower sieve.

9. Dewatering apparatus according to claim 8, wherein said first water removing means comprises a rotatable, closed roll positioned against said upper sieve.

10. Dewatering apparatus according to claim 8, wherein said first water removing means comprises a second rotatable, open forming roll positioned against said lower sieve.

11. Dewatering apparatus according to claim 8, wherein said first water removing means comprises a first suction mechanism for applying a vacuum to said lower sieve.

12. Dewatering apparatus according to claim 8, wherein said secondary dewatering apparatus comprises second means for removing water from said sandwich through said upper sieve.

13. Dewatering apparatus according to claim 12, wherein said second water removing means comprises a rotatable, closed roll positioned against said lower sieve.

14. Dewatering apparatus according to claim 12, wherein said second water removing means comprises a third rotatable, open forming roll positioned against said upper sieve.

15. Dewatering apparatus according to claim 12, wherein said second water removing means comprises a second suction mechanism for applying a vacuum to said upper sieve.

16. Dewatering apparatus according to claim 1, wherein when said sandwich passes over said first open forming roll said upper sieve and said lower sieve contact said first forming roll over a contact angle of between 15° and 45°.

17. Dewatering apparatus according to claim 16 further comprising means for applying a vacuum to said first forming roll over a region bounded by said contact angle.

18. Dewatering apparatus in a two-wire former having a lower flexible wire sieve formed into an endless loop and an upper flexible wire sieve formed into an endless loop, means for spraying a paper suspension onto said lower sieve, means for moving said lower sieve and said paper suspension in a flow direction, means for positioning said upper sieve parallel to, but spaced from, and over said lower sieve to form a sandwich with a paper suspension between said upper and said lower sieves and means for moving said upper sieve in said flow direction, said dewatering apparatus comprising:

an open forming roll, said forming roll being positioned with respect to said sandwich so that said sandwich passes over said forming roll and changes said flow direction;

an auto-slice suction box positioned within said upper sieve loop at a position downstream in said flow direction from said forming roll;

a plurality of upper rails positioned within said upper sieve loop and transverse to said flow direction and located at a position downstream in said flow direction from said auto-slice suction box;

means for adjusting said plurality of upper rails to press each of said upper rails against said upper sieve;

a first suction box surrounding a first predetermined number of said plurality of upper rails for drawing water away from said first predetermined number of said plurality of upper rails, said first suction box being interconnected with and downstream of said auto slice suction box;

means for applying a vacuum to said first suction box;

a second suction box located at a position downstream in said flow direction from said first suction box and interconnected with said first suction box and surrounding a second predetermined number of said plurality of upper rails for drawing water away from said second predetermined number of said plurality of upper rails;

means for applying a vacuum to said second suction box;

lower dewatering apparatus positioned against said lower sieve opposite said suction box, said lower dewatering apparatus including a plurality of lower rails including means for independently biasing each of the rails toward the lower sieve, the lower rails being positioned so that the lower rails bear upon the lower sieve at positions thereon between each of the upper rails so that the lower rails and adjacent upper rails form therebetween a wave-like shape in the sandwich for further dewatering; and secondary dewatering apparatus positioned downstream in said flow direction from said suction box.

19. Dewatering apparatus according to claim 18, wherein said forming roll is located within said lower sieve loop.

20. Dewatering apparatus according to claim 18, wherein said forming roll is located within said upper sieve loop.

21. Dewatering apparatus in a gap former having a lower flexible wire sieve formed into an endless loop and an upper flexible wire sieve formed into an endless loop, means for positioning said upper sieve parallel to, but spaced from, and over said lower sieve to form a gap therebetween, means for spraying a paper suspension into said gap to form a sandwich with a paper suspension between said upper and said lower sieves, means for moving said sandwich in a flow direction, said dewatering apparatus comprising:

an open forming roll, said forming roll being positioned with respect to said sandwich to that said sandwich passes over said forming roll and changes said flow direction;

an auto-slice suction box positioned within said upper sieve loop at a position downstream in said flow direction from said forming roll;

a plurality of upper rails positioned within said upper sieve loop and transverse to said flow direction and located at a position downstream in said flow direction from said auto-slice suction box;

means for adjusting said plurality of upper rails to press each of said upper rails against said upper sieve;

a first suction box surrounding a first predetermined number of said plurality of upper rails for drawing water away from said first predetermined number of said plurality of upper rails, said first suction box being interconnected with and downstream of said auto-slice suction box;

means for applying a vacuum to said first suction box;

a second suction box located at a position downstream in said flow direction from said first suction box and interconnected with said first suction box and surrounding a second predetermined number of said plurality of upper rails for drawing water away from said second predetermined number of said plurality of upper rails;

means for applying a vacuum to said second suction box;

lower dewatering apparatus positioned against said lower sieve opposite said suction box, said lower dewatering apparatus including a plurality of lower rails including means for independently biasing each of the rails toward the lower sieve, the lower rails being positioned so that the lower rails bear upon the lower sieve at positions thereon between each of the upper rails so that the lower rails and adjacent upper rails form therebetween a wave-like shape in the sandwich for further dewatering; and secondary dewatering apparatus positioned downstream in said flow direction from said suction box.

22. Dewatering apparatus according to claim 21, wherein said forming roll is located within said lower sieve loop.

23. Dewatering apparatus according to claim 21, wherein said forming roll is located within said upper sieve loop.

* * * * *